US008126382B2

(12) United States Patent
Derimiggio

(10) Patent No.: US 8,126,382 B2
(45) Date of Patent: Feb. 28, 2012

(54) PASSIVE IR OIL RATE SENSOR

(75) Inventor: John E Derimiggio, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 448 days.

(21) Appl. No.: 12/352,136

(22) Filed: Jan. 12, 2009

(65) Prior Publication Data

US 2010/0178087 A1 Jul. 15, 2010

(51) Int. Cl.
*G03G 15/20* (2006.01)

(52) U.S. Cl. ..... 399/325

(58) Field of Classification Search ..... 399/325
See application file for complete search history.

(56) References Cited

U.S. PATENT DOCUMENTS

| | | | | |
|---|---|---|---|---|
| 5,061,965 | A * | 10/1991 | Ferguson et al. | 399/325 |
| 6,263,182 | B1 * | 7/2001 | Baker et al. | 399/325 |
| 7,214,462 | B2 | 5/2007 | Gervasi | |
| 2006/0239728 | A1 * | 10/2006 | Van Bortel | 399/325 |

* cited by examiner

*Primary Examiner* — David Gray
*Assistant Examiner* — Erika J Villaluna
(74) *Attorney, Agent, or Firm* — Ronald E. Prass, Jr.; Prass LLP

(57) ABSTRACT

This is a system to coat oil on a fuser roller in a xerographic marking procedure. The system has an IR sensor which is located adjacent to the metering roller and which measures the emissivity of an oil film on the metering roller. Once the IR sensor determines the emissivity of this film, it conveys the emissivity reading to a controller. The controller then controls the metering roller speed to thereby control the oil film thickness. Once a fixed oil film is determined, the emissivity can be used to ensure this same film thickness is applied from run to run. There is no need to redesign the entire oil coating apparatus when the desired film thickness is varied, the same apparatus is used only the emissivity will vary to vary the oil film thickness.

12 Claims, 1 Drawing Sheet

PASSIVE IR OIL RATE SENSOR

This invention relates generally to an electrophotographic printing machine, and more specifically concerns a fuser apparatus for fixing a powdered toner image to a copy sheet.

BACKGROUND

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material including toner into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy sheet. Heat via the fuser roller(s) is applied to the toner particles to permanently affix the powder image to the copy sheet.

Some problems may occur when the recording sheet with toner passes through the fuser rollers. One such problem occurs when the toner on the recording sheet adheres to one of the fuser rollers resulting in image contamination as the toner does not adhere to the correct location on the recording sheet or remains on the roller and is not transferred to the recording sheet. An additional problem occurs when the recording sheet is inadvertently wound around one of the fuser rollers causing a paper jam.

Oil is applied to one or both of the fuser rollers to overcome these problems. The oil reduces the amount of toner that adheres to the rollers and also lessens the likelihood of the recording sheet becoming entangled. An oil applicator is positioned adjacent to the rollers for distributing the oil. The application of oil to the fuser rollers may result in additional problems if the correct amount is not applied. Any suitable oil can be used in the present invention such as the oils disclosed in U.S. Pat. No. 7,214,462; the disclosure of U.S. Pat. No. 7,214,462 is incorporated by reference into the present disclosure.

Inconsistent oil transfer to the rollers during the life of the oil applicator could cause other problems. Many designs result in an over-abundance of oil being transferred to the fuser roller early in the life of the applicator. Too much oil distributed onto the rollers may be transferred to the recording sheet resulting in oil spots that are visible to the user thereby ruining the sheet. The same applicators often do not apply an adequate amount of oil during the end of their life. When applying inadequate oil, results in toner adhering to the fuser rollers and/or the recording sheet sticking to the fuser rollers, both of which are unacceptable results. Inconsistent oil application also makes it difficult to predict the expected life of the oil applicator.

In prior art systems, variations in the oil surface thickness, oil temperature or oil viscosity generally requires a total redesign of the oil application structure. Each system has a fixed oil application operating temperature, oil viscosity, and an applied film thickness. This is a serious disadvantage that is overcome by the present invention. There was little, if any, variation control of variable oil rate application.

SUMMARY

The present invention provides a system that measures the amount of oil applied to the fuser roller(s) by measuring the surface IR emissivity of the metering roller in a metering/donor roll oil application system. The emissivity of the metering roller surface is a function of the film thickness of the oil layer on the surface. Thus, provided by the present invention is a system and method to measure the amount of oil applied to a fuser roller by constant measuring of IR emissivity. Emissivity, as noted, measured by an IR sensor is a function of the thickness of the oil layer on the fuser roll surface. "Emissivity" can be defined as the measure of a surface's ability to emit long-wave infrared (IR) radiation. The lower the emissivity, the higher the far-infrared reflection. Infrared radiation is that which is sensed by the body as heat. Thus, emissivity is the ability of a surface to emit radiant energy compared to that of a black body at the same temperature and with the same area.

In the present invention, an IR sensor adjacent the oil film surface together with a controller controls the speed of the oil metering roll. This IR sensor is electrically connected to a controller which can measure and control the desired oil film rate or thickness. The IR sensor will measure the emissivity of the oil film and will then supply the required or desired oil film thickness. In one embodiment, the oil generally has the composition of the oil disclosed in U.S. Pat. No. 7,214,462. Thus, if a certain oil surface thickness is desired on the fuser roll since there is a direct correlation of the emissivity and the surface thickness varied oil thickness are achievable. All a user needs to do is determine what emissivity he or she wants, add oil from the metering roll until the IR sensor registers the emissivity desired; then the controller connected to the sensor will lock in the desired emissivity and oil thickness desired. Any suitable controller may be used that will control the amount of oil from the metering roll. Any suitable known IR sensor may be used that is configured to effectively measure the emissivity of the oil surface coating used in this invention. While this disclosure and claims describe the invention using a fuser roller, it should be understood that the present invention can be used to control oil film thickness on any other suitable low emissivity roller or surface. The term "fuser roller" used throughout will include these other surfaces.

In the prior art, if the oil surface thickness or amount is to vary from run to run, the entire coating assembly has to be redesigned. In the present invention, the same assembly can be used for any surface oil coating desired. The oil rate can be varied and the same system with an IR sensor and corresponding controller can be used. In one embodiment, a spectral filter between 5 and 15 um can be used to increase the sensitivity of the sensor to match the emissive bands of polydimethylsiloxane (PDMS) fluids.

DETAILED DISCUSSION OF DRAWINGS AND PREFERRED EMBODIMENTS

Figure 1:
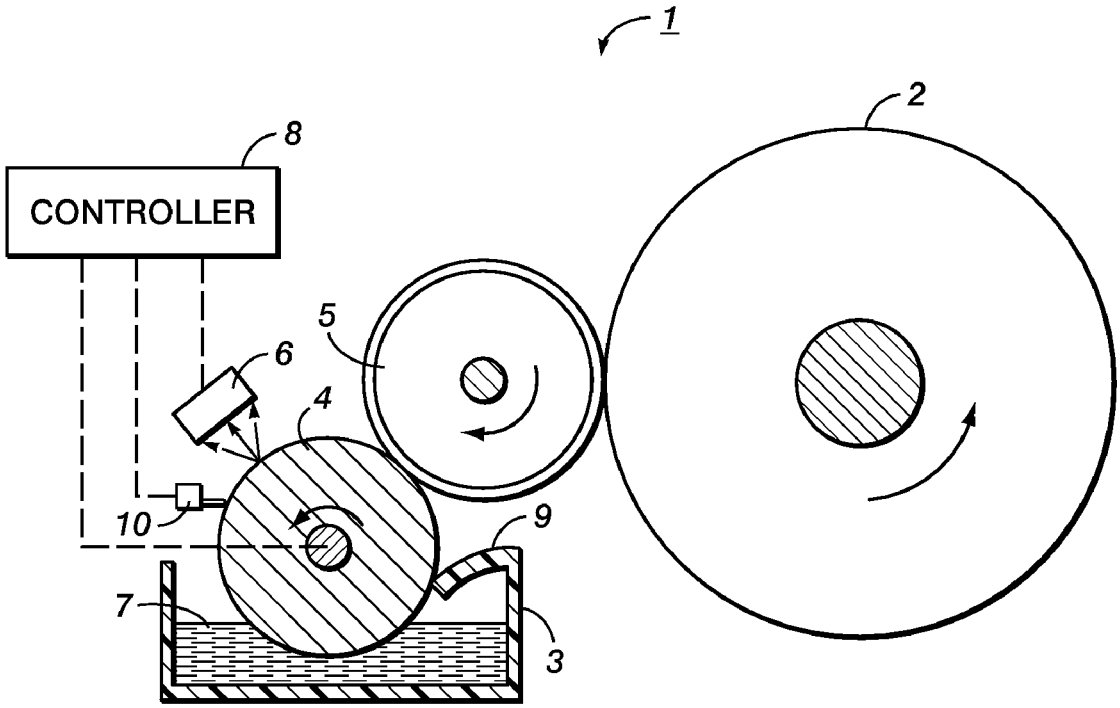
FIG. 1 illustrates an embodiment of this invention showing a schematic of the oil coating system.

In FIG. 1, an oil application system 1 is shown where a fuser roller 2 is being coated with oil. A source oil from oil housing 3 is in flow contact with a metering roller 4. The metering roller 4 deposits the oil 7 to a donor roller 5; from there the donor roller 5 deposits an oil film upon the surface of fuser roller 2. The donor roller 5 has an outside surface comprising Viton®. Viton® is a trademark of DuPont. Viton® fluoroelastomer is the most preferred fluoroelastomer, well known for its excellent (400 degree F./200 degree C.) heat resistance. Viton® offers excellent resistance to aggressive fuels and chemicals and has worldwide ISO 9000 and ISO/TS 16949 registration. An IR sensor 6 measures the emissivity of the oil on the surface of metering roller 4. Since the amount of oil on the surface of metering roller 4 is directly proportional to the emissivity of the oil layer, it is easy to control the rate of the oil deposited on the metering roller 4 by controlling this emissivity. A pressure roller is not shown in FIG. 1, but it is understood that the pressure roller is in contact at any location with the fuser roller 2. For clarity, the pressure roller is not shown. In FIG. 1 a controller 8 is in electrical connection with the IR sensor 6 to control the flow of oil 7 to the metering roller 4. FIG. 1 shows the basic diagram of an embodiment of the roller oil application system 1 herein described.

The metering roller 4 is normally heated in order to make the viscosity of the oil 7 less variable due to warm up and running transients. Bare metal rollers usually have low IR emissivity, on the order of 0.05 to 0.20. That means at a given temperature, metal rollers emit 5 to 20% of the infrared radiation that a black body radiator would at the same temperature. In contrast, polymers such as silicone oil 7 have high emissivity, often in the range of 0.85 to 0.95. As a result, as the metering roller 4 gets coated with silicone oil 7, its apparent emissivity will increase.

This can be used to estimate how much silicone oil 7 is coated on the metering roller 4. For a given temperature of the metering roller 4 which is measured by a contact temperature sensor 10, there will be an expected amount of IR signal from the IR sensor 6 for a given amount of silicone on the roller 4. As the silicone film thickness increases the IR sensor 6 will indicate increased IR radiation, and vice-versa as the silicone thickness decreases.

This function: silicone thickness=f(IR, metering roller temp) is probably best determined empirically but an estimate can be generated using first principles. Also, sensitivity may be enhanced by windowing the IR sensor 6 between specific wavelengths. Now that an effective silicone thickness sensor 6 is available, it can be used for closed loop process control of the oil rate. In this example, the metering roller 4 speed can be used to adjust the film thickness (the faster the speed, the higher the thickness past the doctor blade 9). The sensor 6 output can then be used to vary the metering roller 4 speed to control the oil film thickness.

The oil rate that is applied to the fuser is directly proportional to the oil film on the metering roller 4 after the donor roller 5 nip. By monitoring the oil film thickness here, one can know and control the amount of oil application to the fuser roller 2 and hence the media. The metering roller 4 is chrome plated and has a very low IR emissivity in the wavelengths of interest between 1 and 20 um. Also during release agent management (RAM) operation the metering roller 4 is heated to approximately 145° C. This is convenient because the metering roller 4 will self emit IR so the measuring system can be passive without the need for active controlled IR illumination. Up to now in the prior art the only question is if the difference in this surface emissivity is large enough in the range of oil rates used in our process (3 to 15 ul/sheet) and whether available technology is sensitive enough to discriminate these levels. Now we have data from a demonstration system that clearly indicates that we can.

Demonstration of effectiveness of invention: A variable speed metering roller RAM system was installed in a xerographic marking system. Oil rate is then adjustable by changing the rotational speed of the metering roller relative to the donor roller. An IR temperature sensor, such as Omega Engineering OS36-J model was installed so that the metering roller surface temperature is measured after the metering roller/donor roller nip. The oil film thickness at this point indicates the amount of oil that was transferred to the donor roller and ultimately the fuser roller. The metering roller is controlled at a constant temperature of about 142° C. This was verified by reading the process control thermistor on the roller. Oil rate was presumptively varied and print samples were taken to measure the actual oil on the prints corresponding to the test condition. Six metering roller speeds were run and the oil rate and indicated temperature of the metering roller was measured by the IR probe. The effective emissivity of the metering roller was calculated.

Figure 2:
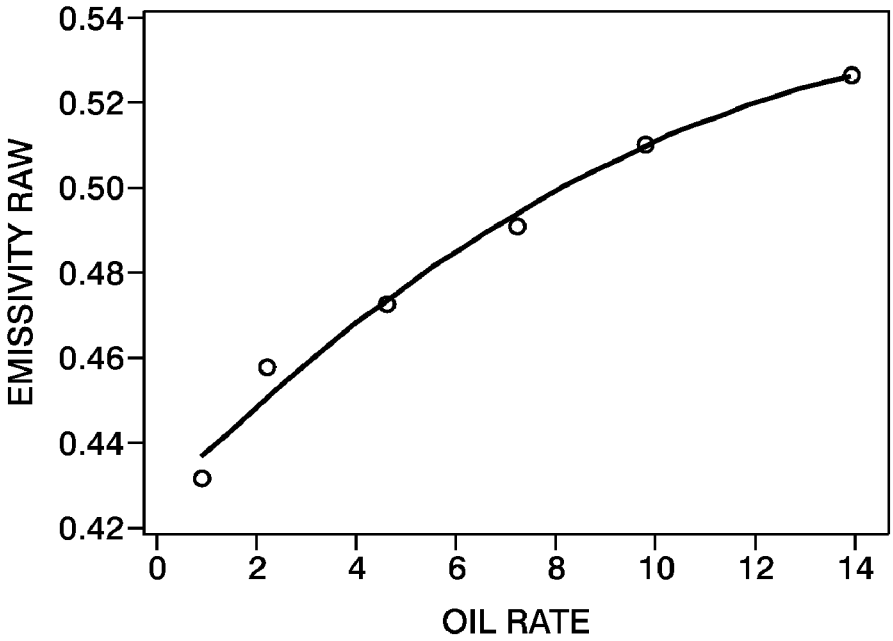
FIG. 2 is a graph plotting emissivity vs. oil rate.

In FIG. 2, the results of the above demonstration are plotted and shown of M/R emissivity versus oil rate. As can be seen in this plot, there is provided an effective, robust and useful emissivity versus oil rate signal in the oil rate range of interest. This signal can be used for closed loop process control of the RAM system. The below table shows emissivity versus oil rate. Oil rate units in this below table are ul per 8.5×11" print

| Emissivity | Oil Rate |
|---|---|
| 0.446743 | 0.9 |
| 0.460793 | 2.2 |
| 0.471566 | 4.6 |
| 0.490105 | 7.2 |
| 0.504478 | 9.8 |
| 0.506406 | 13.9 |

Once the emissivity is measured, the desired oil rate can be achieved by controlling the specific oil rate corresponding to the emissivity measured. The IR sensor is electrically connected to a controller that is configured to receive emissivity information from the IR sensor ad enabled to thereafter control a flow rate or dispensing of the oil to the donor roller based upon said emissivity.

As above noted, the emissivity of a material is the rate of thermal energy radiated by the material to energy radiated by a black body at the same temperature per unit area. In the present invention, once the desired oil rate is determined, the corresponding emissivity can be set to provide that oil rate.

In summary, this invention provides an oil application system useful in applying an oil coating to a fuser roller in a xerographic marking system. This system comprises a fuser roller, an oil containing housing or reservoir, a metering roller, a donor roller, an IR sensor, and a controller connected to said IP sensor. The metering roller and the donor roller are positioned between the fuser roller and the oil containing housing. The IR sensor is positioned adjacent the metering roller and is configured to measure an emissivity of an oil coating on the metering roller. The metering roller is configured to transport oil from the oil housing to the donor roller. The donor roller is configured to accept an oil coating from the metering roller and to transfer the oil to a surface of the fuser roller.

The IR sensor is electrically connected to a controller which is configured to receive emissivity information from the IR sensor and is configured to thereafter control a flow rate or dispensing of the oil to the donor roller based upon the indicated emissivity. The metering roller has positioned a doctor blade in contact with its surface at a location after contact of the metering roller with the donor roller.

The donor roller has an outside surface comprising Viton. The metering roller comprises a heater. This heater is capable of controlling a viscosity of the oil.

In an embodiment this system comprises a fuser roller, an oil containing housing or reservoir, a metering roller, a donor roller, and an IR sensor, and a controller connected to the IP sensor. The metering roller and the donor roller are positioned between the fuser roller and the oil housing. The IR sensor is positioned adjacent the metering roller and is configured to measure an emissivity of an oil coating on the metering roller. This IR sensor is configured to indicate increased IR radiation as said oil film or coating thickness increases and vice-versa as the oil film thickness decreases. The IR sensor and the controller together are configured to vary the metering roller speed to thereby control the oil film thickness based upon emissivity of the oil film. The IR sensor is configured to measure emissivity of the oil coating on the metering roller, and configured to communicate this emissivity to the controller. The controller is in contact with the metering roller and is adapted to adjust the film thickness on the metering roller. The IR sensor is electrically connected to a controller which is configured to receive emissivity information from the IR sensor and configured to thereafter control a flow rate or dispensing of the oil to the donor roller based upon said emissivity.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system to control oil film thickness on a low emissivity surface, said system useful in a xerographic marking system, said system comprising:

a fuser roller, an oil containing housing or reservoir, a metering roller, a donor roller, and an IR sensor, a controller connected to said IR sensor, said metering roller and said donor roller positioned between said fuser roller and said oil containing housing, said IR sensor positioned adjacent said metering roller and configured to measure an emissivity of an oil coating on said metering roller.

2. The system of claim 1 wherein said metering roller is configured to transport oil from said housing to said donor roller.

3. The system of claim 1 wherein said donor roller is configured to accept an oil coating from said metering roller and to transfer said oil to a surface of said fuser roller.

4. The system of claim 1 wherein said IR sensor is electrically connected to a controller, said controller configured to receive emissivity information from said IR sensor and configured to thereafter control a flow rate or dispensing of said oil to said donor roller based upon said emissivity.

5. The system of claim 1 wherein said metering roller has positioned a doctor blade in contact with its surface at a location after contact of said metering roller with said donor roller.

6. The system of claim 1 wherein said donor roller has an outside surface comprising Viton®.

7. The system of claim 1 wherein said metering roller comprises a heater, said heater capable of controlling a viscosity of said oil.

8. An oil application system useful in applying an oil coating to a fuser roller in a xerographic marking system, said system comprising a fuser roller, an oil containing housing or reservoir, a metering roller, a donor roller, and an IR sensor, and a controller connected to said IR sensor, said metering roller and said donor roller positioned between said fuser roller and said housing, said IR sensor positioned adjacent said metering roller and configured to measure an emissivity of an oil coating on said metering roller, said IR sensor configured to indicate increased IR radiation as said oil film or coating thickness increases and vice-versa as the oil film thickness decreases, said IR sensor and said controller together configured to vary said metering roller speed to thereby control said oil film thickness based upon emissivity of said oil film, said IR sensor configured to measure emissivity of said oil coating on said metering roller, and configured to communicate said emissivity to said controller, said controller in contact with said metering roller and adapted to adjust said film thickness on said metering roller.

9. The system of claim 8 wherein said metering roller is configured to transport oil from said housing to said donor roller.

10. The system of claim 8 wherein said donor roller is configured to accept an oil coating from said metering roller and to transfer said oil to a surface of said fuser roller.

11. The system of claim 8 wherein said IR sensor is electrically connected to a controller said controlled configured to receive emissivity information from said IR sensor and configured to thereafter control a flow rate or dispensing of said oil to said donor roller based upon said emissivity.

12. The system of claim 8 wherein said metering roller has positioned a doctor blade in contact with its surface at a location after contact of said metering roller with said donor roller.

* * * * *